United States Patent [19]

Wuerfel

[11] 4,164,916

[45] Aug. 21, 1979

[54] VARIABLE DISPLACEMENT ARRANGEMENT IN FOUR CYCLE, RECIPROCATING, INTERNAL COMBUSTION ENGINE

[76] Inventor: Robert P. Wuerfel, 4620 NW. 45 Ct., Ft. Lauderdale, Fla. 33319

[21] Appl. No.: 931,566

[22] Filed: Aug. 7, 1978

[51] Int. Cl.[2] ..... F02B 75/04

[52] U.S. Cl. ..... 123/78 C; 123/78 B; 123/48 C; 123/193 CP

[58] Field of Search ..... 125/48 C, 48 R, 78 C, 125/78 B, 78 R, 51 R, 52 B, 53 BP, 193 P, 193 CP

[56] References Cited

U.S. PATENT DOCUMENTS 1,532,788 4/1925 Vandervell ..... 123/48 C 2,060,263 11/1936 Sweeney ..... 123/1 R

FOREIGN PATENT DOCUMENTS 18623 of 1912 United Kingdom ..... 123/48

*Primary Examiner*—Charles J. Myhre
*Assistant Examiner*—M. Moy
*Attorney, Agent, or Firm*—Oltman and Flynn

[57] ABSTRACT

Concentric outer and inner pistons are provided in each cylinder of a four cycle, reciprocating, internal combustion engine. A magnet restrains each outer piston against displacement by pressure of the fuel mixture in the cylinder, so that the outer piston does not move while the engine is under low load. However, while the engine is under substantial load the magnetic restraint is overcome and the outer piston is displaced by pressure of the fuel mixture in the cylinder.

15 Claims, 5 Drawing Figures

VARIABLE DISPLACEMENT ARRANGEMENT IN FOUR CYCLE, RECIPROCATING, INTERNAL COMBUSTION ENGINE

BACKGROUND OF THE INVENTION

In the conventional four cycle, reciprocating, internal combustion engine, particularly on automotive vehicles, the engine typically is operating under substantially no load or light load much of the time. During such no load or light load conditions only a relatively small engine displacement is needed. It is only when the engine is under heavy load that higher engine displacement is required, such as when starting or accelerating the vehicle. However, these heavy load conditions dictate the engine displacement even when light load conditions are involved because the engine must have the capacity to handle the heavy load conditions satisfactorily.

Thus, there has existed the problem of improving the efficiency of such engines by automatically varying the engine displacement in accordance with the load on the engine, with the engine displacement being minimized under low load conditions and greatly increased under high load conditions.

My U.S. patent application Ser. No. 837,030, filed Sept. 2, 1977, discloses a novel arrangement in which the engine displacement is varied in accordance with the load by providing a spring acting between each engine piston and the crankshaft so as to provide a stiff coupling between them under engine idle or other substantially no load conditions and to provide a resiliently deformable coupling under heavy load which deforms in proportion to the load. The expansion of this spring is limited so that when expanded to the full extent permitted the spring is compressed with a force equal to the piston force required to compress the fuel mixture during the compression stroke for proper combustion when the engine is under substantially no load.

SUMMARY OF THE INVENTION

The present invention relates to a concentric engine piston arrangement for giving a four cycle, reciprocating, internal combustion engine the desired variable displacement characteristic. It has in each engine cylinder an annular outer piston, which is yieldably restrained against displacement in response to pressure of the fuel mixture, and an inner piston slidable inside each outer piston and displaceable by the pressure of the fuel mixture regardless of the load on the engine. The yieldable restraint on the outer piston preferably is provided by a magnet which prevents displacement of the outer piston by the fuel mixture while the engine is running under low load but permits its displacement by the fuel mixture while the engine is under substantial load.

Accordingly, a principal object of this invention is to provide a novel and improved arrangement in a four cycle, reciprocating, internal combustion engine for varying the engine displacement in accordance with the load on the engine.

Another object of this invention is to provide such a variable displacement arrangement having concentric inner and outer pistons in each engine cylinder and means for imposing on each outer piston a restraint against its displacement by pressure of the fuel mixture in that cylinder, which restraint is overcome when the engine is under substantial load.

Another object of this invention is to provide a novel variable displacement arrangement having concentric inner and outer pistons as just described in which the restraint is exerted by a magnet.

Further objects and advantages of this invention will be apparent from the following detailed description of certain presently-preferred embodiments, shown in the accompanying drawings in which.

Before explaining the disclosed embodiment of the present invention in detail, it is to be understood that the invention is not limited in its application to the details of the particular arrangements shown since the invention is capable of other embodiments. Also, the terminology used herein is for the purpose of description and not of limitation.

Figure 1:
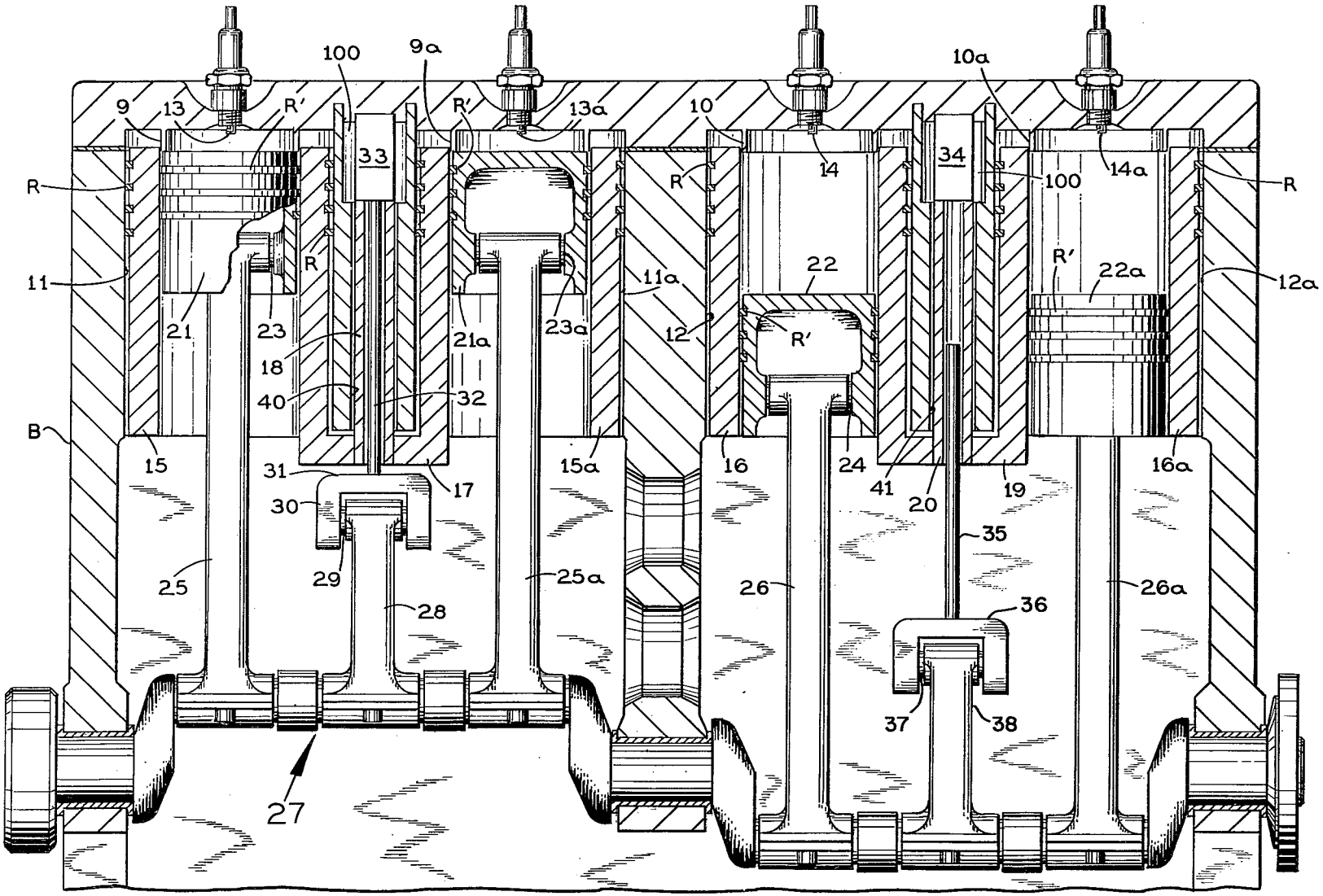
FIG. 1 is a sectional view through the cylinders of a four cylinder engine embodying the present variable displacement arrangement, with the engine being under low load.

Referring to FIG. 1, the present invention is shown embodied in a four cycle, reciprocating, internal combustion engine having a cylinder block B which provides four cylinders 11, 11*a*, 12 and 12*a*, here shown as extending parallel to one another. The upper end of each cylinder is provided with the usual valved inlet and exhaust ports in the area over the inner piston (not shown) and a respective inner spark plug 13, 13*a*, 14 or 14*a* for igniting the combustible fuel mixture at appropriate times.

A respective cylindrical, hollow, outer piston 15, 15*a*, 16 or 16*a* is slidably reciprocable in each cylinder. A respective rim 9, 9*a*, 10 or 10*a* is fixedly located at the upper end of each cylinder in FIG. 1 to provide a means of preventing the compressed fuel mixture from entering the area over the outer piston while this outer piston is being restrained against displacement.

Some leakage of fuel mixture from the combustion chambers over the inner pistons, around and past the circular rims 9–9*a* and 10–10*a*, into the combustion chamber areas over the outer pistons will occur. The amount of this leakage will determine the required strength of the magnets 33 and 34. So as to hold the outer piston in the top position and restrain them from moving during low load operation.

Figure 3:
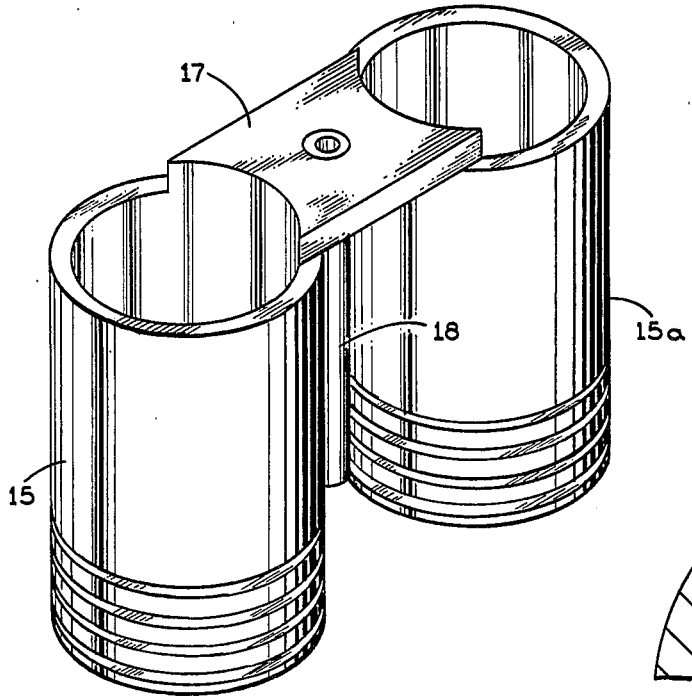
FIG. 3 is a perspective view showing one of the pairs of interconnected outer pistons in the present variable engine displacement arrangement.
Figure 4:
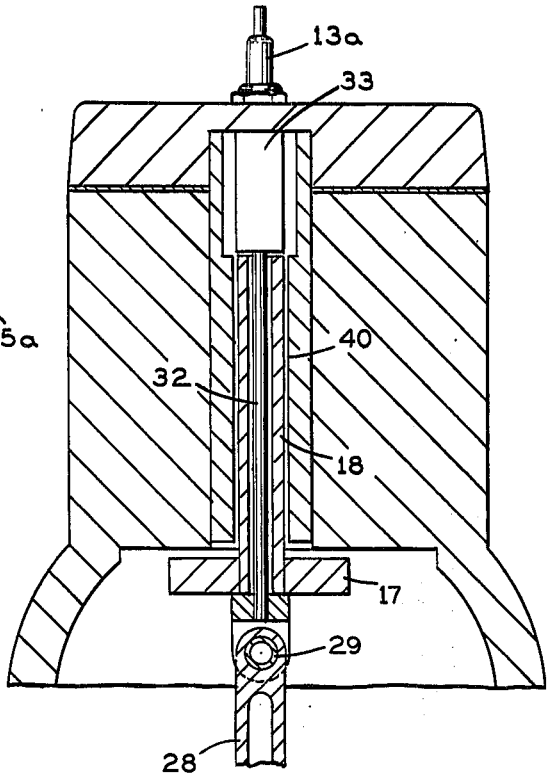
FIG. 4 is a section taken along the line 4—4 in FIG. 2.

As best seen in FIG. 3, the adjoining outer pistons 15 and 15*a* are rigidly attached together by a transverse end plate 17 extending between them at the end away from the respective spark plugs 13 and 13*a* (FIG. 1), so that these two outer pistons make up a first unitary pair. A rigid tube 18 of magnetically attractable material is rigidly attached to the end plate 17 and extends between, and parallel to, the paired outer pistons 15 and 15*a*. This tube 18 is shorter than the two outer pistons to which it is connected by the end plate 17. Tube 18 is reciprocable in a cylindrical bore 40 in the cylinder block B and it has a slight annular clearance from the sidewall of this bore.

The other two outer pistons 16 and 16*a* are arranged to form a second unitary pair, being connected by a transverse end plate 19 similar to the end plate 17 for the first pair of outer pistons. A tube 20 is joined to the end plate 19 and extends from it between, and parallel to, the outer cylinders 16 and 16*a* of the second pair. Tube 20 is of magnetically attractable material, and it is reciprocable in a cylindrical bore 41 in the cylinder block B and has a slight clearance from the sidewall of this bore.

Each outer piston 15, 15*a*, 16 or 16*a* carries respective piston rings R for slidable sealing engagement with the respective cylinder 11, 11*a*, 12 or 12*a*.

Each outer piston 15, 15*a*, 16 or 16*a* slidably receives a respective concentric inner piston, 21, 21*a*, 22 or 22*a*. Each inner piston carries respective piston rings R' for slidable sealing engagement with the inside of the respective outer piston 15, 15*a*, 16 or 16*a*.

The inner pistons have respective wrist pins 23, 23*a*, 24, 24*a* which rotatably connect them to the outer ends of respective connecting rods 25, 25*a*, 26 and 26*a*. The inner ends of these connecting rods are rotatably coupled to the usual engine crankshaft 27. The connecting rods 25 and 25*a* for the first pair of inner pistons 21 and 21*a* are mounted on the same segment of the crankshaft so that they move in unison. This is also true of the crankshafts 26 and 26*a* for the second pair of inner pistons 22 and 22*a*.

A connecting rod 28 for the first pair of outer pistons 15 and 15*a* is rotatably coupled at its inner end to the engine crankshaft 27 between the connecting rods 25 and 25*a* for the first pair of inner pistons 21 and 21*a*. A wrist pin 29 on the outer end of the connecting rod 28 is rotatably connected to a bifurcated carrier 30 of generally U-shaped configuration. The bight segment of this carrier presents a flat outer face 31 which is in confronting relationship to the end plate 17 joining the outer pistons 15 and 15*a* of the first pair. An elongated guide rod 32 is attached to the carrier 30 at the middle of its outer face 31 and it extends with a loose fit longitudinally through the tube 18.

Between the adjoining first pair of cylinders 11 and 11*a* the engine block fixedly supports a permanent magnet 33 of known design in registration with the outer end of tube 18. Tube 18 being of magnetically attractable material, as already mentioned, the magnet force exerted on it by the magnet 33 is strong enough to hold its outer end against the inner face of the magnet 33 at all times when the engine is under low load, as shown in FIG. 1.

There is side space clearance at 100 around the magnets 33 and 34. This is so as to provide a closed core magnetic path.

Similarly, between the adjoining second pair of cylinders 12 and 12*a* the engine block supports a second permanent magnet 34 which holds the tube 20 against its inner end face, as shown in FIG. 1, at all times when the engine is under low load.

A guide rod 35 extends slidably through the tube 20 and has its inner end attached to a bifurcated carrier 36 for a wrist pin 37 on the outer end of a connecting rod 38. The inner end of connecting rod 38 is rotatably coupled to the same section of the engine crankshaft 27 as the connecting rods 26 and 26*a* for the respective inner pistons 22 and 22*a*.

At low load on the engine, each permanent magnet 33 or 34 will hold the adjoining pair of outer pistons 15–15*a* or 16–16*a* fixedly positioned within the respective cylinders 11–11*a* or 12–12*a*, as shown in FIG. 1, the top end of the outer pistons extending beyond the bottom end of the circular rims 9–9*a* or 10–10*a*. The pressure of the fuel mixture on these outer pistons is not enough to overcome the restraining force exerted by the magnets 33 and 34 as long as the engine is under low load.

However, when there is substantial load on the engine, the resulting increased pressure of the fuel mixture in each engine cylinder will act against the outer end of the corresponding outer piston 15, 15*a*, 16 or 16*a* and cause the latter to be displaced inward (i.e. toward the engine crankshaft 27) against the holding force exerted by the respective permanent magnet 33 or 34.

Figure 2:
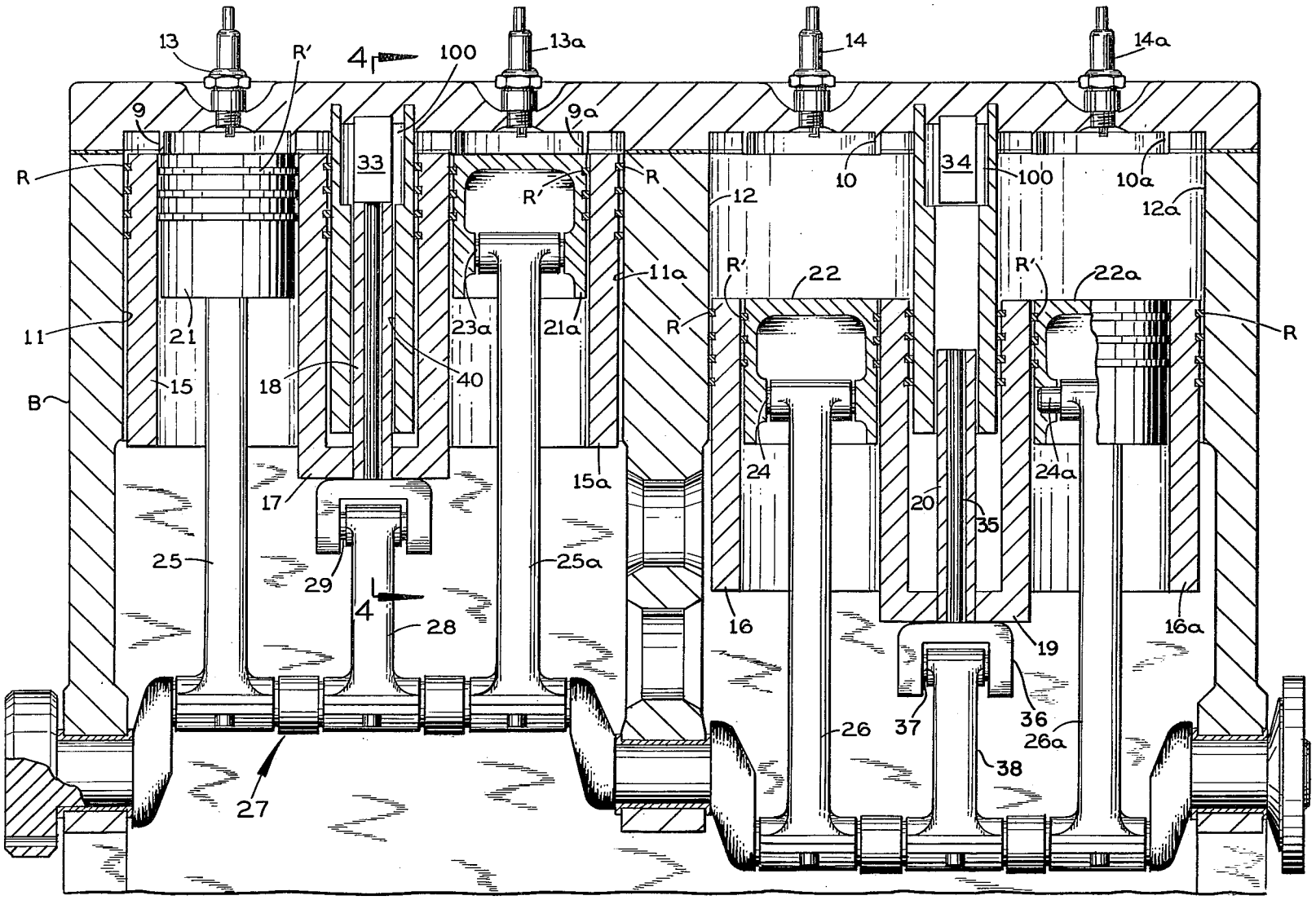
FIG. 2 is a view similar to FIG. 1 but with the engine being under substantial load.

FIG. 2 shows the outer pistons 16 and 16*a* moving in unison with the respective inner pistons 22 and 22*a* away from the respective spark plugs 14 and 14*a*. This is the situation when the load on the engine is a mxximum, and in the present invention this produces the maximum volumetric displacement of the concentric pistons in the engine cylinders by virtue of the fact that each outer piston is displaced as much as the corresponding inner piston.

The transition from low load operation (inner pistons only reciprocating ) FIG. 1 to maximum load operation (inner and outer pistons reciprocating together) FIG. 2 will be determined by the strength of the restraining force holding the outer pistons in the static top position. This transition will take place automatically when the force of the ignited fuel mixture exerted on outer pistons exceed the holding force of the magnets 33 and 34.

Figure 5:
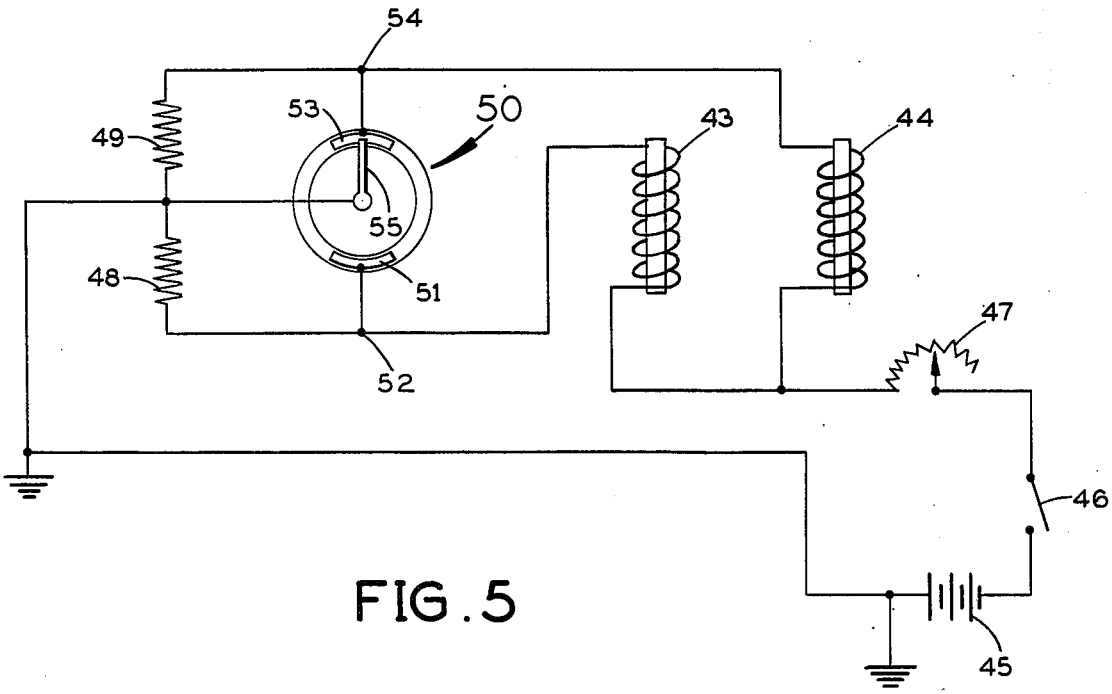
FIG. 5 is a schematic diagram of an electrical circuit for energizing electromagnets in a modified embodiment of the present variable engine displacement arrangement.

Where, as in FIG. 5, electromagnets are used to replace the fixed magnets 33 and 34 the transition point can be changed by changing the holding force by means of adjusting the rheostat 47.

As already explained, the inner pistons are arranged in pairs 21–21*a* and 22–22*a* for movement in unison, and this is also true of the outer pistons, which are arranged in pairs 15–15*a* and 16–16*a* for movement in unison. With this arrangement, when either piston of either pair is in its power stroke the other piston of that same pair will be in its intake stroke, and when either piston of either pair is in its compression stroke the other piston of that same pair will be in its exhaust stroke.

While the invention has been illustrated in a four cylinder engine having paired outer pistons and paired inner pistons, it is to be understood that the invention might be embodied as well in a six cylinder or eight cylinder engine having similarly paired outer and inner pistons. Also, it might be embodied in an engine with any desired number of cylinders in which there is no pairing of outer and inner pistons, in which case each outer piston would have its own individual restraining magnet.

FIG. 5 shows schematically the electrical circuit for an alternative arrangement in which the permanent magnets 33 and 34 in FIGS. 1 and 2 are replaced by electromagnets 43 and 44, respectively. The circuit provides reduced energization of the electromagnets except when the fuel pressure in the respective paired cylinders 11–11*a* or 12–12*a* is high enough to require increased energization. This minimizes the electrical power consumption of the electromagnets.

Referring to FIG. 5, one terminal of the vehicle battery 45 is connected through an on-off switch 46 and a rheostat 47 to one terminal of each electromagnet 43 and 44. The opposite terminals of these electromagnets are connected through respective resistors 48 and 49 to the grounded opposite terminal of the vehicle battery.

The switch 46 is closed when the engine ignition switch (not shown) is closed.

The circuit also includes a commutator 50 having a first arcuate fixed contact 51, which is connected to the juncture 52 between the coil of electromagnet 43 and resistor 48, and a second arcuate fixed contact 53, which is connected to the juncture between the coil of electromagnet 44 and resistor 49. The arcuate fixed contacts 51 and 53 are diametrically opposite one another. The commutator has a grounded rotary contact 55 which is slidably engageable individually with the fixed contacts 51 and 53 at different times during each of its rotations. The rotary contact 55 is rotated at the same speed of the engine ignition distributor. It slidably engages the fixed contact 51 during the period of maximum pressure in either cylinder 11 or 11*a*, and it slidably engages the fixed contact 53 during the period of maximum pressure in either cylinder 12 or 12*a*.

It will be apparent that when the rotary contact 55 engages neither of the fixed contacts 51 and 53 in the commutator, both electromagnets 43 and 44 have their energization circuits completed through high resistance paths via resistors 48 and 49, so that only small current will be drawn by the electromagnets at these times. When the rotary contact 55 engages the fixed contact 51, the commutator short-circuits resistor 48 and therefore the current through the electromagnet 43 is increased substantially. Similarly, when the rotary contact 55 engages the other fixed contact 53, the resistor 49 will be short-circuited and the current through the electromagnet 44 is increased substantially.

The timing of the commutator is such that enough current is supplied to the electromagnet 43 to exert a significant restraining force on the corresponding magnetically attractable tube 18 only when one or the other of the corresponding engine cylinders 11 or 11*a* is at or close to the maximum fuel pressure during a given engine operating sequence. At other times heavy current to the electromagnet is not required because the cylinder pressure is not high enough to displace the corresponding outer piston 15 or 15*a*.

Similarly, the electromagnet 44 receives high enough current to exert a significant restraint on the magnetically attractable tube 20 only when one or the other of the corresponding engine cylinders 12 or 12*a* is at or close to maximum pressure during a given operating sequence of the engine.

With this arrangement of variably energized electromagnets 43 and 44 (in place of the permanent magnets 33 and 34), each electromagnet will prevent the respective pair of outer pistons 15–15*a* or 16–16*a* from being displaced by the pressure of the fuel mixture when the engine is under low load. However, when the engine is under substantial load the restraint exerted by the electromagnets will not be enough to prevent such displacement of the corresponding pair of outer pistons.

If desired, the yieldable restraint on each outer piston could be provided by a spring or other mechanical restraint, or by a pneumatic cylinder-and-piston or diaphragm, or by hydraulic cylinder-and-piston or diaphragm, or by frictional brake, in place of the permanent magnet or electromagnet, as shown.

I claim:

1. In a four cycle, reciprocating, internal combustion engine having a cylinder, means for introducing a fuel mixture into the cylinder, means for igniting the fuel mixture, means for exhausting the burned gasses from the cylinder, and an engine crankshaft, the improvement which comprises:

a hollow outer piston reciprocable in said cylinder;

an inner piston reciprocable in said outer piston and exposed thereat to pressure of the fuel mixture introduced into the cylinder, said inner piston being operatively connected to the engine crankshaft;

yieldable means biasing said outer piston against movement in the cylinder in response to pressure of the fuel mixture, said yieldable means being operative to prevent such movement of the outer piston while the engine is under low load, said yieldable means being operative to permit movement of the outer piston in the cylinder in response to pressure of the fuel mixture while the engine is under substantial load;

and means for coupling said outer piston to the engine crankshaft when the outer piston moves in the cylinder in response to ignition of the fuel mixture while the engine is under substantial load;

said yieldable means comprising magnet means biasing said outer piston against movement in said cylinder under pressure of the fuel mixture.

2. An engine according to claim 1, wherein said magnet means is outside the cylinder, and said yieldable means also comprises a magnetically attractable member outside the cylinder which is connected to said outer piston and operatively arranged to be attracted by said magnet means for restraining the outer piston against movement in said cylinder.

3. An engine according to claim 2, wherein said magnet means is a permanent magnet.

4. An engine according to claim 2, wherein said magnet means comprises an electromagnet, and means for varying the energization of said electromagnet to provide maximum energization thereof when the pressure of the fuel mixture in the cylinder is at a maximum and to reduce the energization when the pressure of the fuel mixture in the cylinder is substantially less than said maximum.

5. An engine according to claim 2, wherein said coupling means comprises:

a connecting rod operatively connected at one end to the engine crankshaft;

a wrist pin rotatably coupled to the outer end of the connecting rod;

and a carrier for the wrist pin positioned to be engaged and displaced by the outer piston when the latter moves in the cylinder in response to pressure of the fuel mixture therein.

6. An engine according to claim 5, wherein said magnetically attractable member is a tube located outside the engine cylinder and attached to said outer piston and extending parallel to the axis of the engine cylinder, and further comprising a rod extending from said carrier slidably into said tube.

7. An engine according to claim 1, wherein said coupling means comprises:

a connecting rod operatively connected at one end to the engine crankshaft;

a wrist pin rotatably coupled to the outer end of the connecting rod;

and a carrier for the wrist pin positioned to be engaged and displaced by the outer piston when the latter moves in the cylinder in response to pressure of the fuel mixture therein.

8. In a four cycle, reciprocating, internal combustion engine having at least four cylinders, means for introducing a fuel mixture at different times into the four cylinders, means for igniting the fuel mixture in the four cylinders at different times, means for exhausting the burned gasses from the four cylinders at different times, and an engine crankshaft, the improvement which comprises:

a respective hollow outer piston reciprocable in each of the four cylinders, said outer pistons being connected in first and second pairs for the movement in unison of both outer pistons in either pair;

a respective inner piston reciprocable in each outer piston and exposed thereat to pressure of the fuel mixture in the respective cylinder, each said inner piston being operatively connected to the engine crankshaft;

first yieldable means biasing the first pair of outer pistons against movement in the respective cylinders in response to pressure of the fuel mixture therein, said yieldable means being operative to prevent such movement of said first pair of outer pistons while the engine is under low load, said yieldable means being operative to permit movement of said first pair of outer pistons in the respective cylinders in response to pressure of the fuel mixture in either of said last-mentioned cylinders while the engine is under substantial load;

first coupling means for coupling said first pair of outer pistons to the engine crankshaft when either of said last-mentioned outer pistons moves in response to pressure of the fuel mixture in the respective cylinder while the engine is under substantial load;

second yieldable means biasing said second pair of outer pistons against movement in the respective cylinders in response to pressure of the fuel mixture therein, said second yieldable means being operative to prevent such movement of said second pair of outer pistons while the engine is under low load, said second yieldable means being operative to permit movement of said second pair of outer pistons in the respective cylinders in response to pressure of the fuel mixture in either of the respective cylinders while the engine is under substantial load;

and second coupling means for coupling said second pair of outer pistons to the engine crankshaft when either outer piston of said second pair moves in response to pressure of the fuel mixture in the respective cylinder while the engine is under substantial load.

9. An engine according to claim 8, wherein each of said yieldable means comprises a respective magnet biasing the respective pair of outer pistons against movement in their cylinders.

10. An engine according to claim 9, wherein each magnet is outside the cylinders, and each of said yieldable means also comprises a respective magnetically attractable member outside the cylinders and connected to the respective pair of outer pistons and operatively arranged to be attracted by the respective magnet for restraining the respective pair of outer pistons against movement in their cylinders under pressure of the fuel mixture therein.

11. An engine according to claim 10, wherein each magnet is a permanent magnet.

12. An engine according to claim 10, wherein each magnet is an electromagnet, and further comprising a commutator operating in timed relation with the ignition of the fuel mixture in each of the corresponding pair of cylinders to provide maximum energization of the electromagnet when the pressure of the fuel mixture in either of said last-mentioned cylinders is at a maximum and to reduce the energization of the electromagnet when the pressure of the fuel mixture in both of said last-mentioned cylinders is substantially less than said maximum.

13. An engine according to claim 10, wherein each of said coupling means comprises:

a respective connecting rod operatively connected at one end to the engine crankshaft;

a respective wrist pin rotatably coupled to the outer end of each connecting rod;

and a respective carrier for each wrist pin positioned to be engaged and displaced by the corresponding pair of outer pistons when the latter move in unison in their cylinders in response to pressure of the fuel mixture in either of the corresponding cylinders.

14. An engine according to claim 13, wherein each magnetically attractable member is a tube attached to the corresponding pair of outer pistons and extending parallel to the axes of the corresponding cylinders, and further comprising a respective rod extending from each carrier slidably into the corresponding tube.

15. An engine according to claim 8, wherein each of said coupling means comprises:

a respective connecting rod operatively connected at one end to the engine crankshaft;

a respective wrist pin rotatably coupled to the outer end of each connecting rod;

and a respective carrier for each wrist pin positioned to be engaged and displaced by the corresponding pair of outer pistons when the latter move in unison in their cylinders in response to pressure of the ignited fuel mixture in either of the corresponding cylinders.

* * * * *